US011267271B2

(12) United States Patent
Kinokuni et al.

(10) Patent No.: US 11,267,271 B2
(45) Date of Patent: Mar. 8, 2022

(54) HEAD MODULE, HEAD DEVICE, AND LIQUID DISCHARGE APPARATUS

(71) Applicant: Ricoh Company, Ltd., Tokyo (JP)

(72) Inventors: Takashi Kinokuni, Tokyo (JP); Takeshi Miyazaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 28 days.

(21) Appl. No.: 16/860,194

(22) Filed: Apr. 28, 2020

(65) Prior Publication Data

US 2021/0001652 A1 Jan. 7, 2021

(30) Foreign Application Priority Data

Jul. 1, 2019 (JP) ..... JP2019-123175

(51) Int. Cl.
*B41J 29/377* (2006.01)
*B41J 2/14* (2006.01)

(52) U.S. Cl.
CPC ..... *B41J 29/377* (2013.01); *B41J 2/14* (2013.01); *B41J 2002/14491* (2013.01); *B41J 2202/08* (2013.01)

(58) Field of Classification Search
CPC ..... B41J 2202/08; B41J 2202/20; B41J 2202/21; B41J 2/1408; B41J 2/155; B41J 29/377; B41J 2/14201; B41J 2202/19; B41J 2002/14491; B41J 2/14
See application file for complete search history.

(56) References Cited

U.S. PATENT DOCUMENTS

| | | | |
|---|---|---|---|
| 2004/0263554 A1 | 12/2004 | Kubo | |
| 2005/0140741 A1 | 6/2005 | Kubo | |
| 2008/0174628 A1 | 7/2008 | Kubo et al. | |
| 2013/0155159 A1 | 6/2013 | Kinokuni et al. | |
| 2013/0182040 A1 | 7/2013 | Kinokuni et al. | |
| 2013/0182044 A1 | 7/2013 | Kinokuni | |
| 2018/0029362 A1* | 2/2018 | Sugiura | B41J 2/1408 |
| 2019/0283416 A1 | 9/2019 | Kinokuni | |

FOREIGN PATENT DOCUMENTS

| | | |
|---|---|---|
| JP | 9-240110 | 9/1997 |
| JP | 2005-035292 | 2/2005 |
| JP | 2005-178306 | 7/2005 |
| JP | 2008-179055 | 8/2008 |
| JP | 2017-065041 | 4/2017 |

* cited by examiner

*Primary Examiner* — Jannelle M Lebron
(74) *Attorney, Agent, or Firm* — Xsensus LLP

(57) ABSTRACT

A head module includes: a plurality of heads, a base on which the plurality of heads is arrayed in a head array direction, a plurality of individual heatsinks respectively attached to the plurality of heads, and a common heatsink standing on the base, the common heatsink including a connector thermally connected to each of the plurality of individual heatsinks. The connector of the common heatsink is along the head array direction and is adjacent to each of the plurality of individual heatsinks in a direction perpendicular to the head array direction.

12 Claims, 8 Drawing Sheets

HEAD MODULE, HEAD DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-123175, filed on Jul. 1, 2019, in the Japan Patent Office, the entire disclosure of which is hereby incorporated by reference herein.

BACKGROUND

Technical Field

An aspect of the present disclosure relates to a head module, a head device, and a liquid discharge apparatus.

Related Art

In a liquid discharge head that discharges a liquid, for example, discharge characteristics of the liquid discharge head fluctuate because of a temperature increase due to heat generated during driving of the liquid discharge head.

SUMMARY

In an aspect of this disclosure, a head module includes: a plurality of heads, a base on which the plurality of heads is arrayed in a head array direction, a plurality of individual heatsinks respectively attached to the plurality of heads, and a common heatsink standing on the base, the common heatsink including a connector thermally connected to each of the plurality of individual heatsinks. The connector of the common heatsink is along the head array direction and is adjacent to each of the plurality of individual heatsinks in a direction perpendicular to the head array direction.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
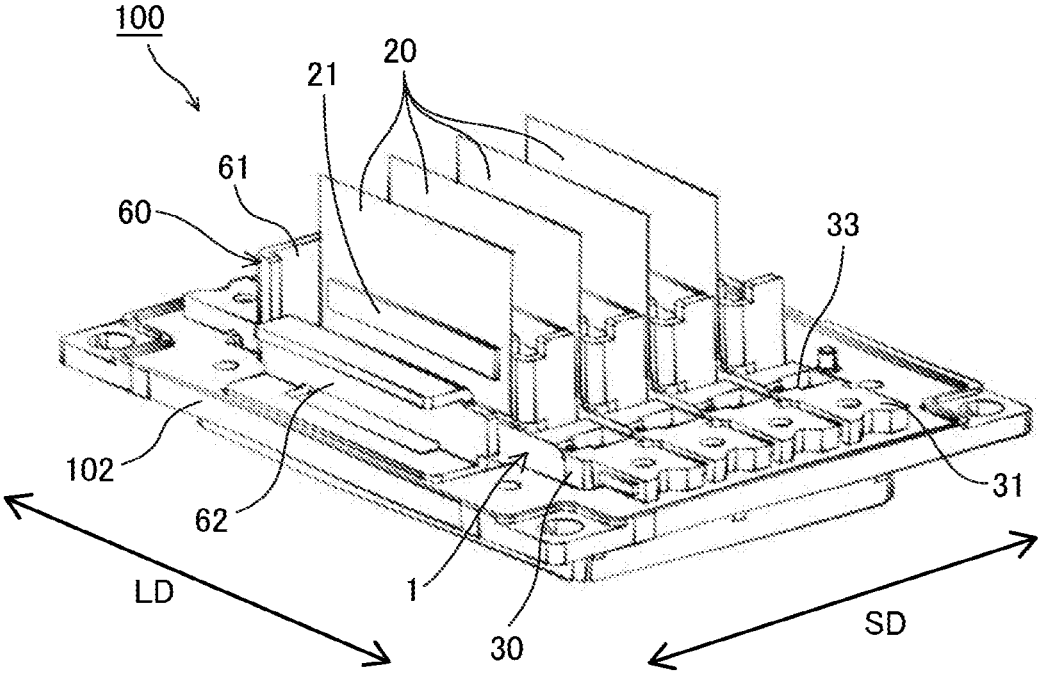
FIG. 1 is a schematic perspective view of a head module according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Embodiments of the present disclosure are described below with reference to the attached drawings. A first embodiment of the present disclosure is described with reference to FIGS. 1 to 4.

Figure 2:
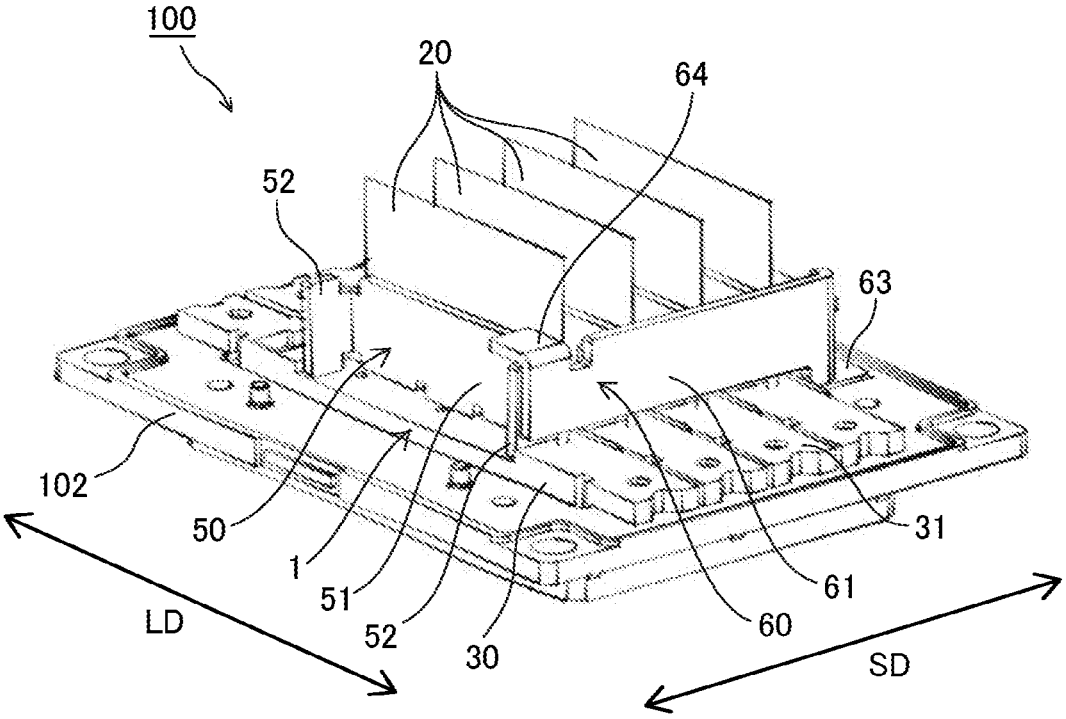
FIG. 2 is a perspective view of the head module viewed from an opposite side of FIG. 1 according to the first embodiment of the present disclosure.
Figure 3:
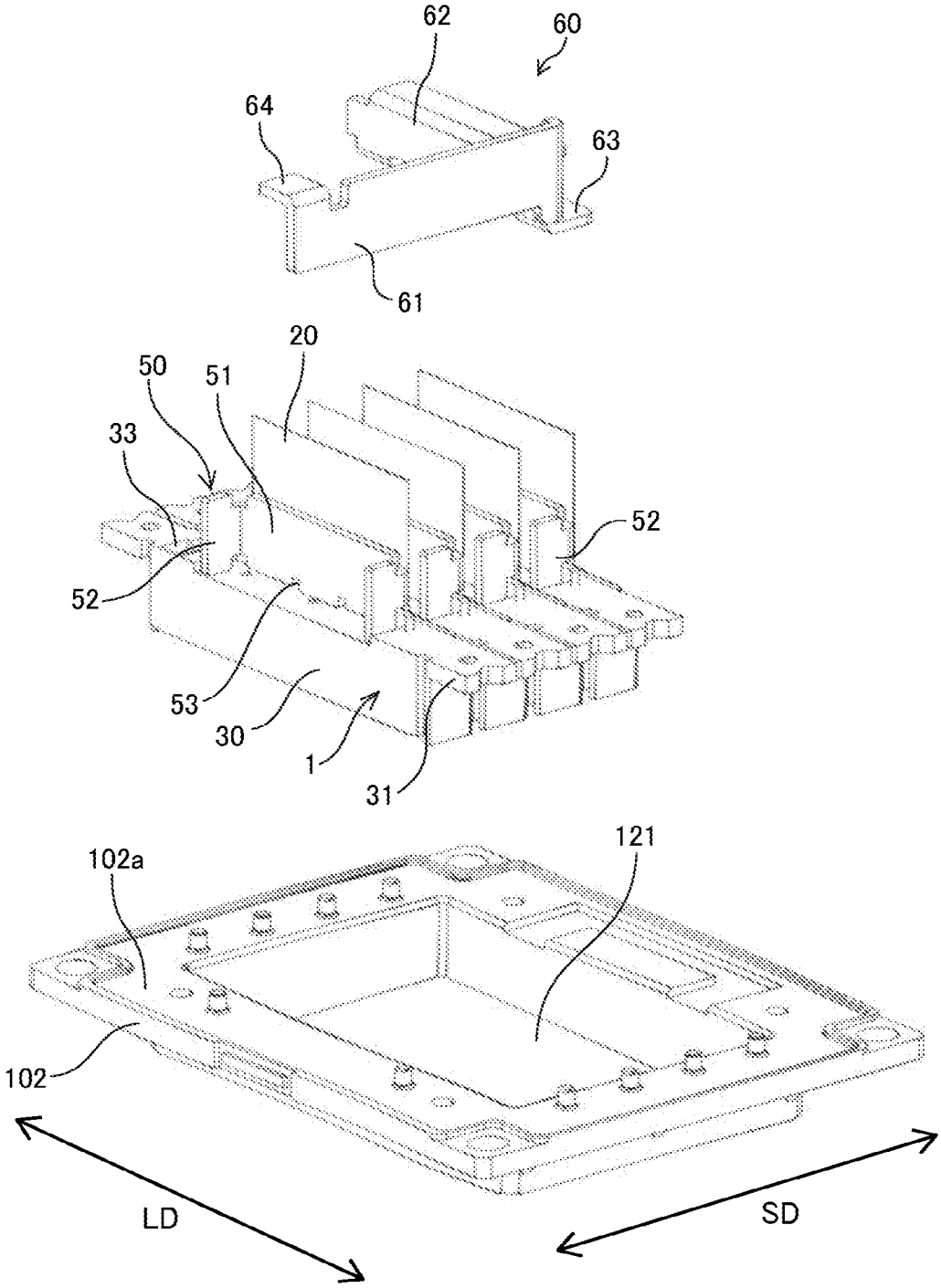
FIG. 3 is an exploded perspective view of the head module according to the first embodiment of the present disclosure.
Figure 4:
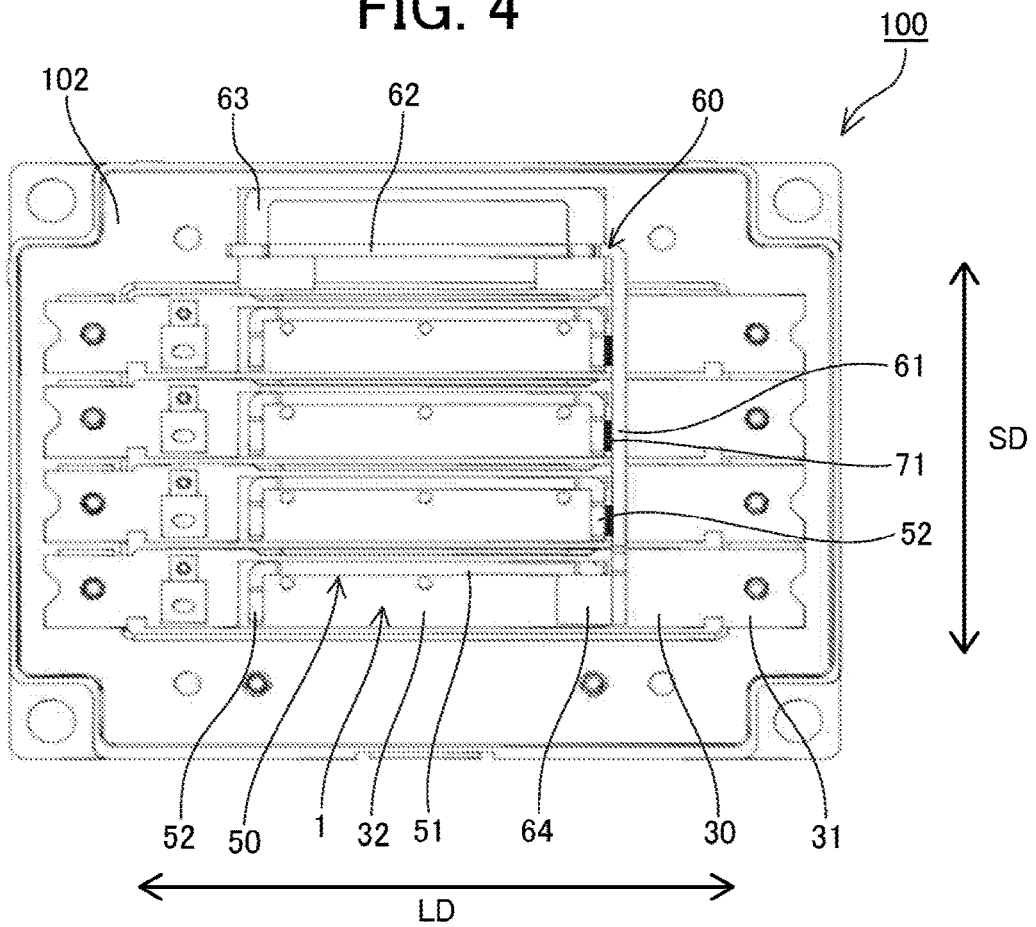
FIG. 4 is a plan view of the head module of FIG. 1.

FIG. 1 is an external perspective view of a head module according to the first embodiment. FIG. 2 is a perspective view of the head module viewed from opposite side of FIG. 1 according to the first embodiment. FIG. 3 is an exploded perspective view of the head module of FIG. 1. FIG. 4 is a plan view of the head module of FIG. 1.

The head module 100 includes a plurality of (here, four) heads 1 which are liquid discharge heads to discharge a liquid. Hereinafter, the "liquid discharge head" is simply referred to as the "head." A wiring 20 such as a flexible printed circuit (FPC) is connected to the head 1, and a drive integrated circuit (drive IC 21) is mounted on the wiring 20.

The plurality of heads 1 are held on a base 102. The base 102 includes an opening 121 into which the plurality of heads 1 are inserted. The head 1 includes a frame 30 and flanges 31 formed on both ends of the frame 30. The flanges 31 of the frame 30 is bonded to the base 102 with an adhesive to hold the head 1 on the base 102. However, the flanges 31 of the frame 30 may be fastened to the base 102 with screws to hold the head 1 on the base 102.

Each of the plurality of heads 1 includes an individual heatsink 50 made of a metal material such as aluminum which is thermally connected to the wiring 20 with a thermal connection device such as a thermal connection tape (thermal conductive adhesive tape). The base 102 includes a common heatsink 60 made of a metal material such as aluminum which is thermally connected to the plurality of individual heatsinks 50 in a direction perpendicular to a surface of the base 102.

Next, the individual heatsinks of the head 1 is described with reference to FIGS. 5 and 6.

Figure 5:
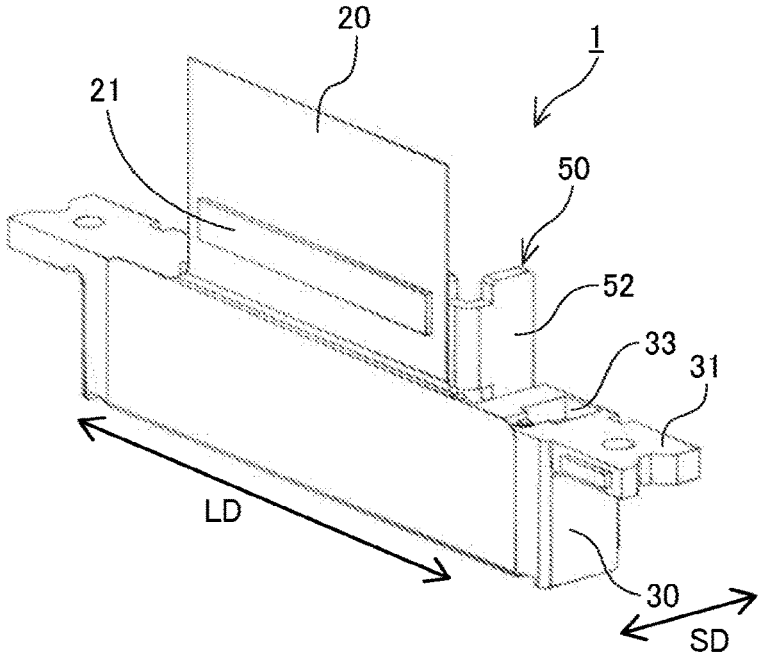
FIG. 5 is an external schematic perspective view of a head illustrating an individual heatsink.
Figure 6:
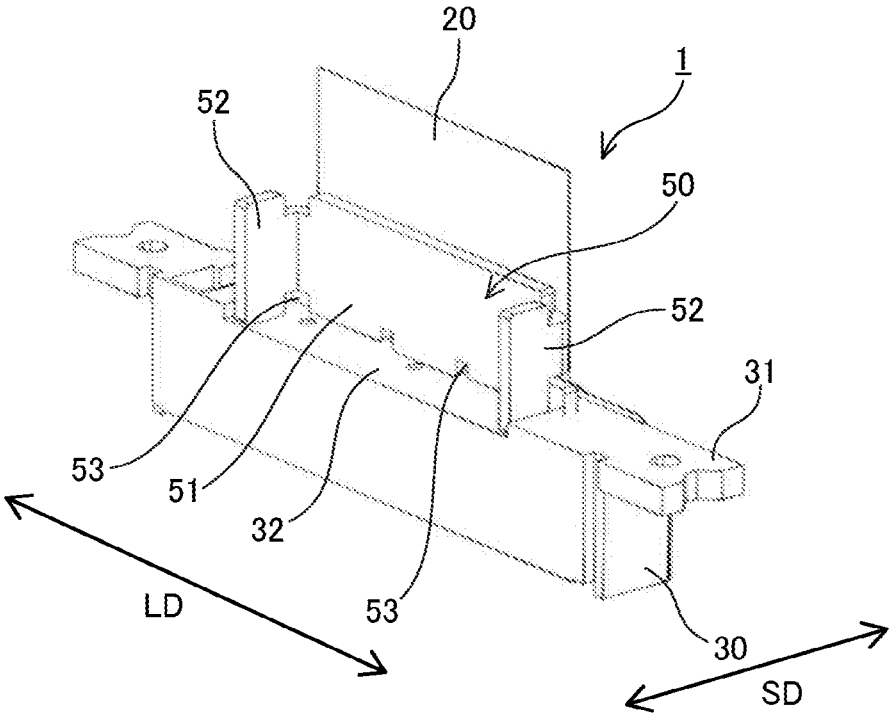
FIG. 6 is an external schematic perspective view of the head viewed from an opposite side of FIG. 5.

FIG. 5 is an external schematic perspective view of the head 1 according to the present embodiment. FIG. 6 is an external schematic perspective view of the head 1 viewed from an opposite side of FIG. 5.

The individual heatsinks 50 includes a main surface 51 and a side surface 52. The main surface 51 is along a longitudinal direction of the head 1 and is connected to the wiring 20 on which the drive IC 21 is mounted. The side surfaces 52 is bent from both ends of the main surface 51 in a short direction of the head 1. The short direction is perpendicular to the longitudinal direction.

The longitudinal direction is indicated by arrow "LD," and the short direction is indicated by arrow "SD" in FIG. 5. The short direction SD of the head 1 is an array direction in which a plurality of heads 1 are arrayed (head array direction), and the longitudinal direction LD of the head 1 is a direction perpendicular to the short direction in which the plurality of heads 1 is arrayed as illustrated in FIG. 4.

The individual heatsinks 50 are disposed on the frame 30 of the head 1. The frame 30 includes a groove 32 in an upper center of the frame 30. The individual heatsinks 50 are fitted into the groove 32. The individual heatsinks 50 and the head 1 are bonded by an adhesive such as an epoxy-based adhesive.

Further, each of the individual heatsinks 50 includes the side surfaces 52 at both ends of the main surface 51 so that each of the individual heatsinks 50 have a channel shape. Thus, the head 1 can increase a contact area between the individual heatsink 50 and the common heatsink 60. At the same time, the head 1 can increase (secure) a fixing strength of the individual heatsink 50 to the head 1 to prevent falling of the individual heatsinks 50 from the head 1.

Notches 53 are formed at a lower end of the main surface 51 and at bent portions formed at connections between the main surface 51 and the side surface 52 of the individual heatsink 50.

Thus, the head 1 reduces a contact area between the individual heatsink 50 and the frame 30 of the head 1 to reduce heat transmitted from the drive IC 21 to the frame 30 of the head 1.

Figure 7:
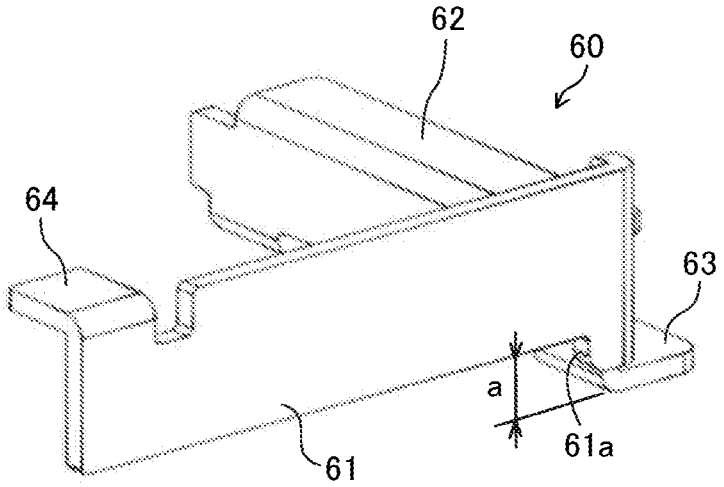
FIG. 7 is a schematic perspective view of a common heatsink.
Figure 8:
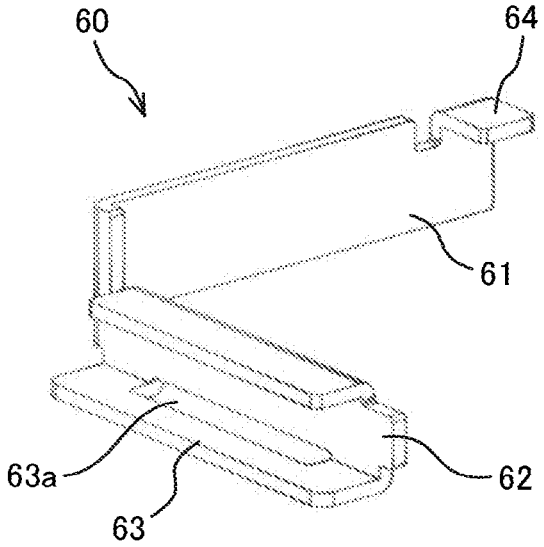
FIG. 8 is a schematic perspective view of the common heatsink viewed from an opposite side of FIG. 7.

Next, a configuration of the common heatsink 60 is described with reference to FIGS. 7 and 8. FIG. 7 is a schematic perspective view of the common heatsink 60. FIG. 8 is a schematic perspective view of the common heatsink 60 viewed from an opposite side of FIG. 7.

The common heatsink 60 is fixed on a mounting surface 102*a* of the base 102 (see FIG. 3). The mounting surface 102*a* of the base 102 holds the flanges 31 of the head 1. The common heatsink 60 stands vertically from the mounting surface 102*a* of the base 102.

The common heatsink 60 includes a connector 61 that thermally connects the plurality of individual heatsinks 50 and a main surface 62 connected to the connector 61. The main surface 62 includes a mounting part 63 formed together with the main surface 62 as a single body. The main surface 62 is attached to the base 102.

The connector 61 of the common heatsink 60 is arrayed along the longitudinal direction LD (see FIG. 4) in which the heads 1 are arrayed (also a direction in which the individual heatsinks 50 are arrayed). Further, the connector 61 is arranged adjacent to one side surface 52 (right side in FIG. 4) of the individual heatsinks 50 in the longitudinal direction LD perpendicular to the short direction SD in which the heads 1 are arrayed (see FIG. 4). Further, a longitudinal direction of the connector 61 is along the short direction SD as illustrated in FIG. 4.

Thus, the connector 61 of the common heatsink 60 is arranged at the one side surface 52 (right side in FIG. 4) of the individual heatsink 50 opposite to another side surface 52 (left side in FIG. 4) of the individual heatsink 50 at which a liquid supply port 33 (see FIG. 1) of the frame 30 of the head 1 is arranged. Thus, a liquid supplied to the head 1 is not affected by the heat transmitted from the connector 61 of the common heatsink 60.

The main surface 62 of the common heatsink 60 is arranged in the longitudinal direction LD perpendicular to the short direction SD (see FIG. 4) in which the heads 1 are arrayed. The mounting part 63 of the common heatsink 60 includes an opening 63*a*. The opening 63*a* is fitted into a projection on the mounting surface 102*a* of the base 102. The mounting part 63 and the mounting surface 102*a* of the base 102 are bonded with an adhesive such as an epoxy-based adhesive.

As illustrated in FIG. 7, the connector 61 of the common heatsink 60 includes a notch 61*a* at a lower end of the connector 61. Thus, the lower end of the connector 61 is separated from a bottom surface of the mounting part 63 by a distance "a." The bottom surface of the mounting part 63 of the common heatsink 60 is installed (attached) to the mounting surface 102*a* of the base 102.

Thus, the connector 61 of the common heatsink 60 is arranged across the plurality of heads 1 while separated (floated) from the frame 30 of the head 1.

Further, the connector 61 of the common heatsink 60 includes an eave 64 at one end of the connector 61 of the common heatsink 60 opposite to another end of the connector at which the main surface 62 is provided. The eave 64 covers the individual heatsink 50 and is separated from the individual heatsink 50.

Thus, the common heatsink 60 has improved workability to be attached to the base 102.

The common heatsink 60 is assembled to the base 102 after the head 1 including the individual heatsinks 50 is assembled to the base 102. The side surface 52 of the individual heatsinks 50 faces a surface of the connectors 61 of the common heatsink 60. Further, the common heatsink 60 is disposed across the plurality of heads 1 (individual heatsinks 50). Thus, a posture of the common heatsink 60 is unstable under own weight.

Therefore, there is a possibility that the common heatsink 60 may fall from the base 102 when the common heatsink 60 is assembled to the base 102.

Thus, the head module 100 in the first embodiment includes the common heatsink 60 with the eaves 64 that covers the side surface 52 of the individual heatsink 50 so that the individual heatsink 50 can receive the common heatsink 60 and prevents the common heatsink 60 from falling from the base 102. Thus, the common heatsink 60 has improved workability to be assembled to the base 102.

Figure 9:
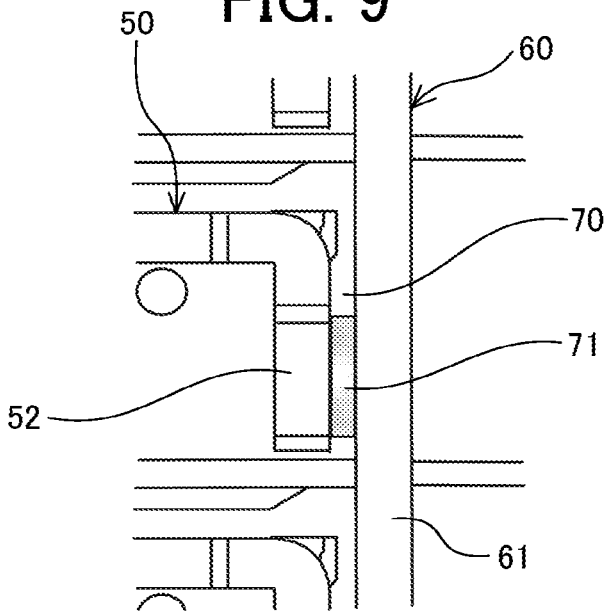
FIG. 9 is an enlarged schematic plan view of a portion of a side surface of the individual heatsink and a connector of the common heatsink illustrating a thermal connection between the individual heatsink and the common heatsink.

Next, a thermal connection between the individual heatsink 50 and the common heatsink 60 is described with reference to FIG. 9. FIG. 9 is an enlarged schematic plan view of a portion of the side surface 52 of the individual heatsink 50 and the connector 61 of the common heatsink 60.

The head module 100 includes a gap 70 between the side surfaces 52 of the plurality of individual heatsinks 50 and a main surface of the connector 61 of the common heatsink 60. A heat conductor 71 such as grease is applied to the gap 70, and the heat conductor 71 is thus interposed between the side surfaces 52 of the plurality of individual heatsinks 50 and a main surface of the connector 61 of the common heatsink 60. Thus, the heat conductor 71 thermally connects the plurality of individual heatsinks 50 and the common heatsink 60.

Since there is tolerance of variations in a positional relationship between the individual heatsinks 50, if the common heatsink 60 and the individual heatsinks 50 are physically contact with each other to be thermal connected, there may exist the individual heatsinks 50 that do not thermally contact with the common heatsink 60.

Therefore, the head module 100 includes the gap 70 between the connector 61 of the common heatsink 60 and the side surface 52 of each individual heatsink 50, and the heat conductor 71 in the gap 70 to thermally connect the common heatsink 60 and each individual heatsink 50.

Thus, the heat conductor 71 in the gap 70 thermally connects the common heatsink 60 and each individual heatsink 50 so that the heat conductor 71 can reliably thermally connect the common heatsink 60 and each individual heatsink 50 even if a distance between the plurality of individual heatsinks 50 and the common heatsink 60 varies.

The heat conductor 71 may be a viscous member. The gap 70 between the side surface 52 of the individual heatsink 50 and the connector 61 of the common heatsink 60 may vary. Thus, when a highly rigid heat conductor such as an aluminum plate is used as the heat conductor 71, a plurality of conductors (aluminum plates) having a thickness corresponding to each gap 70 has to be individually selected.

Conversely, the gap 70 is filled with a viscous heat conductor 71 having viscosity. Thus, the heat conductor 71 can reliably conduct heat between the common heatsink 60 and each individual heatsink 50 without selecting a thickness of the heat conductor 71 for each gap 70 having a different size.

Thus, the heat conductor 71 having viscosity thermally connects the connector 61 of the common heatsink 60 and each of the individual heatsinks 50.

Further, the heat conductor 71 may be an elastic member. The heat conductor 71 having elasticity is interposed between the common heatsink 60 and each individual heatsink 50 so that the heat can be reliably conducted between the common heatsink 60 and each individual heatsink 50 with the heat conductor 71 having only one type of thickness for each gap 70 having a different size. Examples of the heat conductor 71 having elasticity include a rubber material and an elastic adhesive having high heat conductivity.

Thus, the heat conductor 71 having elasticity thermally connects the connector 61 of the common heatsink 60 and each of the individual heatsinks 50.

The head module 100 includes a case 105 (exterior) attached to the head module 100. Further, the head module 100 incudes a nozzle cover 111 that covers a periphery of a discharge surface (nozzle surface) of each head 1. The nozzle cover 111 is attached to the base 102.

Figure 10:
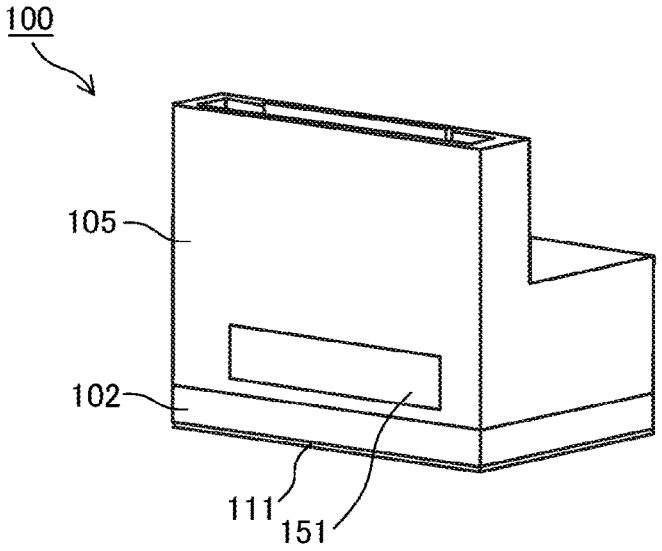
FIG. 10 is an external schematic perspective view of the head module to which a case is attached, illustrating a relation between the common heatsink and the case (exterior) of the head module.

As illustrated in FIG. 10, the case 105 includes an opening 151 facing the main surface 62 of the common heatsink 60 so that the heat inside the case 105 can be radiated outside the head module 100.

Figure 11:
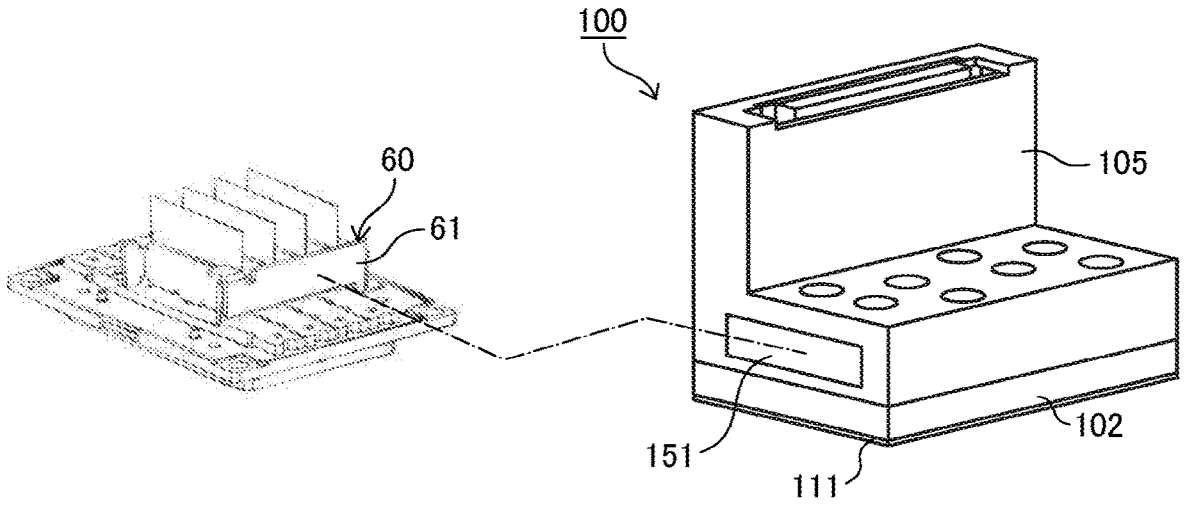
FIG. 11 is an external perspective view of the head module to which the case is attached.

Further, as illustrated in FIG. 11, the case 105 may include an opening 151 facing the connector 61 of the common heatsink 60.

In the head module 100 according to the first embodiment, the heat generated by the drive IC 21 is transmitted to the individual heatsinks 50. Further, the heat is transmitted from the individual heatsinks 50 to the connector 61 of the common heatsink 60 via the heat conductor 71. Further, the heat is transmitted from the connector 61 to the main surface 62 of the common heatsink 60 and is radiated from the opening 151 of the case 105.

A larger heatsink can be thermally connected to the main surface 62 of the common heatsink 60. Thus, a configuration of a heatsink is not limited to a configuration in which heat is directly radiated from the main surface 62 to outside air or the like. The common heatsink 60 may further includes another main surface along a longitudinal direction LD of the head 1 at another end (lower end in FIG. 4) of the connector 61 opposite to one end (upper end in FIG. 4) at which the main surface 62 is provided. Another end of the connector 61 is one end at which the eaves 64 is formed on the connector 61 in FIGS. 7 and 8 in the above embodiment. The head module 100 may include two main surfaces from which the heat is dissipated to outside air or another heatsink.

The head module 100 includes the plurality of individual heatsinks 50 for each head 1 and the common heatsink 60 thermally connected to each of the plurality of individual heatsinks 50 in the present embodiment. Thus, the head module 100 has following advantages compared with a head module including a plurality of individual heatsinks 50 for each head 1 without the common heatsink 60.

First, reduction in a number of parts, assembly steps, and space (layout) of the heatsink, and improved rigidity and strength of the heatsink. Second, reduction in a volume (area) of the individual heatsink of each head 1. Third, an averaged thermal distribution of all the heads 1, and an averaged thermal distribution to adjacent channels of the head 1. Thus, the head module 100 can reduce variations in the discharge characteristics of the heads 1. Further, it is possible to increase commonality of selection of a drive waveform depending on temperature for each head 1. Thus, it is possible to increase commonality of temperature detectors to detect temperature of the heads 1.

The head module 100 in the present embodiment includes the common heatsink 60 standing upright on the base 102. The head module 100 includes a connector 61 thermally connected to the individual heatsinks 50. The connector 61 is adjacent to the individual heatsinks 50 in the longitudinal direction LD (see FIG. 4) perpendicular to the array direction of the heads 1 (short direction SD). The connector 61 is arranged along the short direction SD parallel to the array direction of the heads 1 (see FIG. 4).

The head 1 according to the first embodiment has a configuration in which the wiring 20 is drawn upward above the head 1 (see FIG. 1). Thus, the common heatsink 60 arranged in an extending direction (upward direction) of the wiring 20 may interfere with the wiring 20. To avoid interference between the common heatsink 60 and the wiring 20, the wiring 20 may be meandered to avoid the common heatsink 60. Then, the total length of the wiring 20 increases that increases cost of the wiring 20.

Therefore, the common heatsink 60 stands upright on the base 102 (see FIG. 2), and the connector 61 standing upright is along the short direction SD (see FIG. 4) parallel to the array direction of the individual heatsinks 50. Thus, a degree of freedom of layout above the head 1 is increased, and the common heatsink 60 can be arranged in a narrow area.

Figure 12:
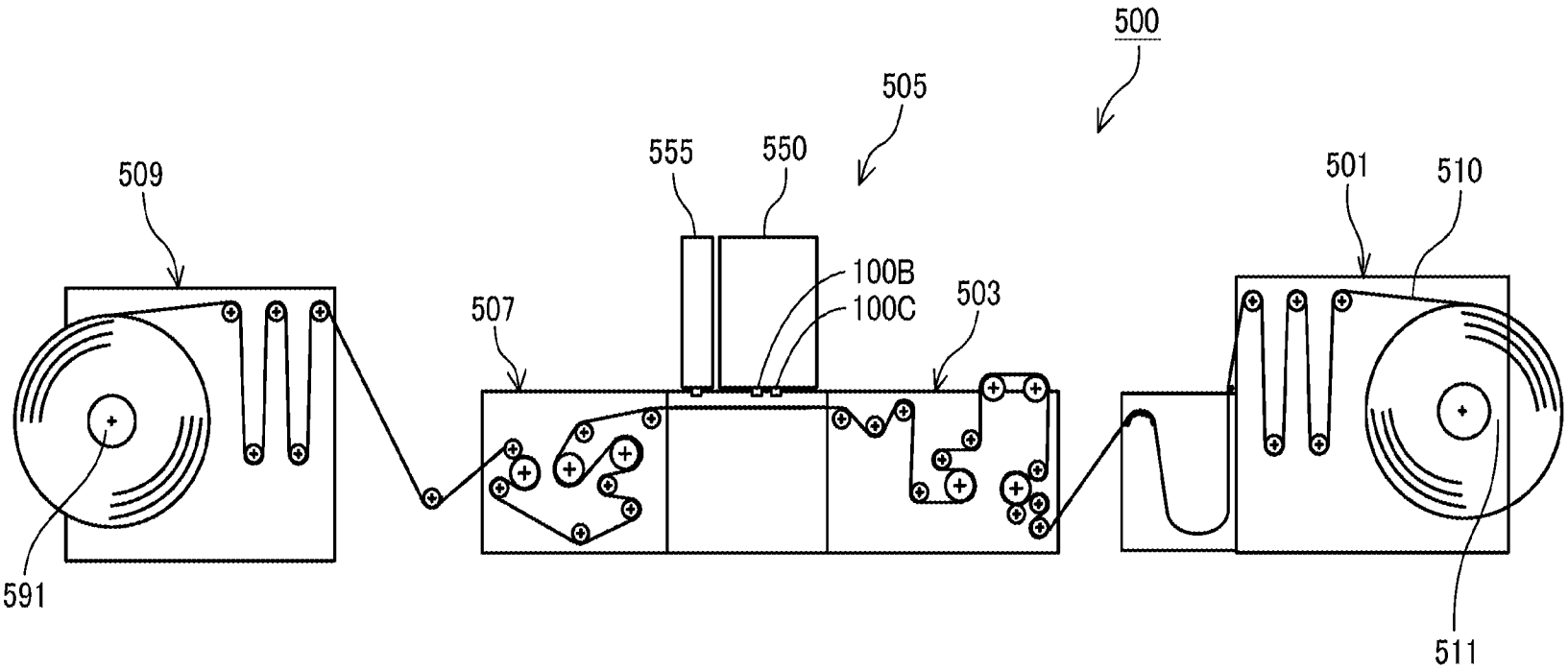
FIG. 12 is a schematic side view of a liquid discharge apparatus according to an embodiment of the present disclosure.

An example of a liquid discharge apparatus according to an embodiment of the present disclosure is described with reference to FIGS. 12 and 13. FIG. 12 is a schematic cross-sectional side view of the liquid discharge apparatus.

Figure 13:
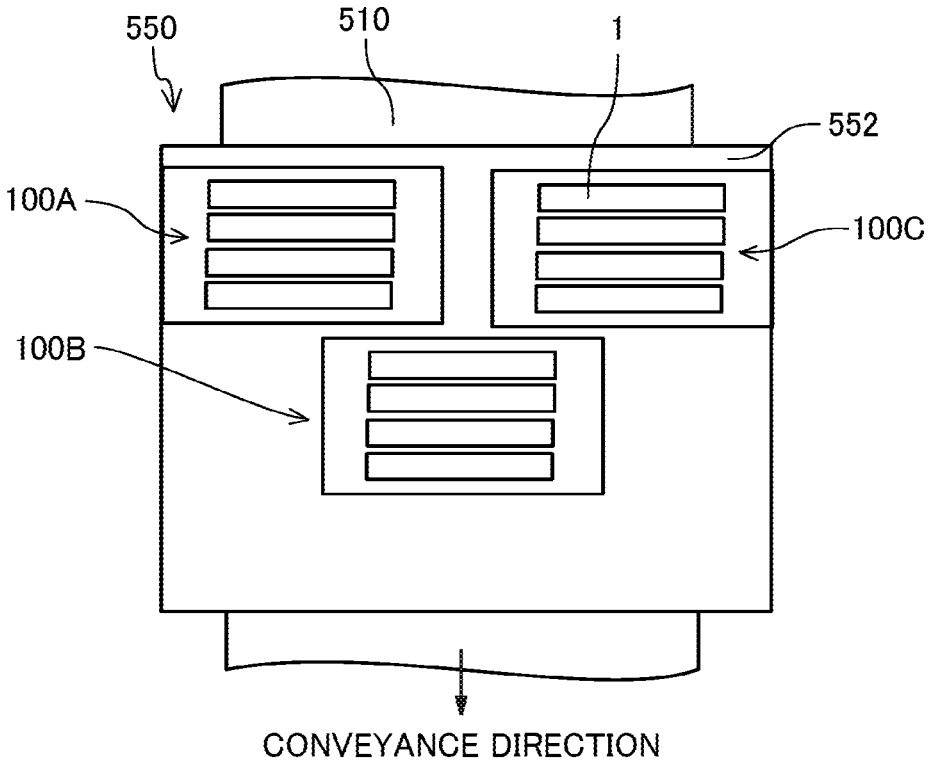
FIG. 13 is a plan view of an example of a head device of the liquid discharge apparatus of FIG. 19.

FIG. 13 is a plan view of a head device of the liquid discharge apparatus of FIG. 12 according to the present embodiment.

A printer 500 serving as the liquid discharge apparatus includes a feeder 501 to feed a continuous medium 510, such as a rolled sheet, a guide conveyor 503 to guide and convey the continuous medium 510, fed from the feeder 501, to a printing device 505, the printing device 505 to discharge a liquid onto the continuous medium 510 to form an image on the continuous medium 510, a dryer 507 to dry the continuous medium 510, and an ejector 509 to eject the continuous medium 510.

The continuous medium 510 is fed from a winding roller 511 of the feeder 501, guided and conveyed with rollers of the feeder 501, the guide conveyor 503, the dryer 507, and the ejector 509, and wound around a take-up roller 591 of the ejector 509.

In the printing device 505, the continuous medium 510 is conveyed opposite a head devices 550 and 555 in a conveyance direction as indicated by arrow in FIG. 13. The head device 550 discharges a liquid from the heads 1 to form an image on the continuous medium 510.

Here, the head device 550 includes three head modules 100A, 100B, and 100C according to the present embodiments on the common base 552. The head device 555 includes two head modules 100A and 100C on the common base 552.

Further, "liquid" discharged from the head is not particularly limited as long as the liquid has a viscosity and surface tension of degrees dischargeable from the head when the head is a liquid discharge head. Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The term "liquid discharge apparatus" used herein also represents an apparatus including the head module or the head device to discharge a liquid by driving the head. The liquid discharge apparatus may be, for example, an apparatus capable of discharging liquid to a material onto which liquid can adhere and an apparatus to discharge liquid toward gas or into liquid.

The "liquid discharge apparatus" may include devices to feed, convey, and eject the material onto which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate.

Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell.

The "material onto which liquid can adhere" includes any material on which liquid is adhered, unless particularly limited.

Examples of the "material onto which liquid can adhere" include any materials on which liquid can be adhered even temporarily, such as paper, thread, fiber, fabric, leather, metal, plastic, glass, wood, and ceramic.

The "liquid discharge apparatus" may be an apparatus to relatively move the head and a material onto which liquid can adhere. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A head module, comprising:

a plurality of heads;

a base on which the plurality of heads is arrayed in a head array direction, the head array direction being perpendicular to a longitudinal direction of each of the plurality of heads;

a plurality of individual heatsinks respectively attached to the plurality of heads; and a common heatsink standing on the base, the common heatsink including a connector thermally connected to each of the plurality of individual heatsinks, wherein the connector of the common heatsink is a single planar plate that extends in the head array direction and is adjacent, in the longitudinal direction, to an end surface of each of the plurality of individual heatsinks, the end surface extending in the head array direction.

2. The head module according to claim 1, further comprising:

a heat conductor having viscosity and thermally connecting the connector of the common heatsink and one of the plurality of individual heatsinks.

3. The head module according to claim 2, wherein each of the plurality of heads includes a wiring mounting a drive integrated circuit, each of the plurality of individual heatsinks includes a main surface contacting the drive integrated circuit and a side surface bent from an end of the main surface; and the heat conductor thermally connects the connector of the common heatsink and the side surface of one of the plurality of individual heatsinks.

4. The head module according to claim 1, further comprising:

a heat conductor having elasticity and thermally connecting the connector of the common heatsink and one of the plurality of individual heatsinks.

5. The head module according to claim 4, wherein each of the plurality of heads includes a wiring mounting a drive integrated circuit, each of the plurality of individual heatsinks includes a main surface contacting the drive integrated circuit and a side surface bent from an end of the main surface, and the heat conductor thermally connects the connector of the common heatsink and the side surface of one of the plurality of individual heatsinks.

6. The head module according to claim 1, wherein each of the plurality of heads includes:

a frame on which one of the plurality of individual heatsinks is attached; and a wiring mounting a drive integrated circuit, and each of the plurality of individual heatsinks includes:

a main surface contacting the drive integrated circuit; and a notch at a lower end of the main surface.

7. The head module according to claim 1, wherein the connector of the common heatsink includes an eave at one end of the connector, the eave covers a part of one of the plurality of individual heatsinks and is separated from the one of the plurality of individual heatsinks.

8. The head module according to claim 1, further comprising:

a case on the base, the case configured to cover the plurality of heads, the plurality of individual heatsinks, and the common heatsink, wherein the common heatsink includes a main surface connected to the connector, and the case includes an opening that faces the main surface of the common heatsink.

9. The head module of claim 1, wherein each of the plurality of heads is arrayed adjacent to one another in the head array direction, without being staggered from one another in the longitudinal direction.

10. The head module of claim 1, wherein each individual heatsink of the plurality of individual heatsinks is connected to the common heatsink only on the end surface of the individual heatsink.

11. A head device comprising:

a plurality of head modules including the head module according to claim 1, and a common base on which the plurality of head modules is arrayed.

12. A liquid discharge apparatus comprising:

the head device according to claim 11, wherein the plurality of heads is configured to discharge a liquid.

* * * * *